US007725978B2

(12) United States Patent
Harr

(10) Patent No.: US 7,725,978 B2
(45) Date of Patent: Jun. 1, 2010

(54) DRAINAGE STRUCTURE CLEANING APPARATUS

(75) Inventor: Robert E. Harr, Pritchett, CO (US)

(73) Assignee: Harr Technologies, LLC, Mosca, CO (US)

( * ) Notice: Subject to any disclaimer, the term of this patent is extended or adjusted under 35 U.S.C. 154(b) by 81 days.

(21) Appl. No.: 11/786,242

(22) Filed: Apr. 11, 2007

(65) Prior Publication Data

US 2007/0186963 A1 Aug. 16, 2007

Related U.S. Application Data

(62) Division of application No. 10/857,411, filed on May 27, 2004, now abandoned.

(60) Provisional application No. 60/492,422, filed on Aug. 4, 2003, provisional application No. 60/476,937, filed on Jun. 9, 2003, provisional application No. 60/476,568, filed on Jun. 6, 2003.

(51) Int. Cl.
*E02F 3/96* (2006.01)
*E02F 3/76* (2006.01)

(52) U.S. Cl. ..... 15/104.31; 15/104.05; 15/104.09; 37/442; 37/444; 37/411; 37/903; 414/722; 172/821; 172/666

(58) Field of Classification Search ..... 15/104.09, 15/104.095, 104.16, 104.05, 104.31, 104.32; 134/6, 166 R, 166 C, 22.1, 22.12; 37/234, 37/341, 379, 443, 264, 444, 411, 103, 901, 37/903, 905, 908; 172/811, 821, 825, 666, 172/684.5, 765, 771; 414/694, 912, 722
See application file for complete search history.

(56) References Cited

U.S. PATENT DOCUMENTS

| | | | | | |
|---|---|---|---|---|---|
| 1,344,249 | A | * | 6/1920 | Stewart | 15/104.31 |
| 1,376,995 | A | * | 5/1921 | Balsley | 15/104.31 |
| 1,599,307 | A | * | 9/1926 | Ward | 15/104.16 |
| 2,132,795 | A | * | 10/1938 | Minier | 294/50.9 |
| 2,402,314 | A | * | 6/1946 | Crane | 15/104.31 |
| 3,042,234 | A | * | 7/1962 | Davis | 414/718 |
| 3,916,471 | A | * | 11/1975 | Maze | 15/104.31 |
| 4,274,797 | A | * | 6/1981 | Coon | 414/694 |
| 5,178,484 | A | * | 1/1993 | Strunk | 404/75 |
| 6,000,152 | A | * | 12/1999 | Tate | 37/405 |

FOREIGN PATENT DOCUMENTS

CA 265254 * 10/1926

* cited by examiner

*Primary Examiner*—Gary K Graham
(74) *Attorney, Agent, or Firm*—Philip G. Meyers

(57) ABSTRACT

An apparatus for cleaning a culvert includes a rod pushing and pulling machine, a rod string made from a series of extension rods coupled end to end, which rod string is mounted at a proximal end to the rod pushing and pulling machine. A debris removal tool is mounted on a distal end of the rod string. The debris removal tool may comprises a rod having a center longitudinal axis, a proximal end, and a distal end, the rod having a coupling at its proximal end. A bucket is mounted at the distal end of the rod, which bucket has an end opening positioned so that movement of the bucket along the culvert scoops debris into the bucket.

14 Claims, 10 Drawing Sheets

DRAINAGE STRUCTURE CLEANING APPARATUS

This application is a division of U.S. Ser. No. 10/857,411, filed May 27, 2004 now abandoned which claims the benefit of U.S. Provisional Patent Application Ser. No. 60/476,568, filed Jun. 6, 2003, U.S. Provisional Patent Application Ser. No. 60/476,937, filed Jun. 9, 2003, and U.S. Provisional Patent Application Ser. No. 60/492,422, filed Aug. 4, 2003.

BACKGROUND

Culverts, pipes, ditches, and other drainage structures are in wide use for such reasons as preventing soil erosion and controlling runoff. Culverts may be installed across or under roadways to prevent flooding of the roadway or to prevent water damage to the surrounding area. In other locations, culverts may be used to prevent alteration of the landscape by erosion, or shifting of the soil, for example. In some areas, controlling runoff from snow melt is another issue that may be addressed, in part, by the use of culverts.

In some cases, a culvert may lose its function because it is clogged with debris. Culverts may become obstructed by soil, rocks, sand, intrusion of plant roots, snow, ice, or other debris. The location of some culverts may make them particularly susceptible to blockage. One way to address these problems is to place a covering or grating over the openings of the culvert. However, these coverings may require extensive and frequent cleaning and may still allow smaller objects such as sand, silt, and gravel to enter the culvert. Additionally, coverings and gratings may not prevent plant roots from clogging the culvert. Culverts can be removed and replaced periodically but this may involve high costs and may involve disturbing existing roadways and other structures.

SUMMARY OF THE INVENTION

The invention provides a tool for cleaning a culvert that includes a rod having a center longitudinal axis, and a housing having a center longitudinal axis and coupled coaxially to the rod, the housing having an interior chamber. The housing has an outside dimension that can be accommodated within the culvert and at least one paddle operable to rotate about the center longitudinal axis of the rod inside the interior chamber of the housing, the at least one paddle operable to dislodge and loosen debris inside the culvert. The rod may further define a fluid-conducting channel and at least one opening proximate to the at least one paddle operable to direct pressurized fluid into the culvert.

The invention provides another tool for cleaning a culvert, which tool comprises a rod having a center longitudinal axis, a proximal end and a distal end. The rod has a coupling at its proximal end. An elongated bucket is coupled to the distal end of the rod, the rod operable to extend the bucket into the culvert and loading debris into the bucket. The bucket may be substantially cylindrical or cubical, and may have an end opening that opens towards the distal end of the rod, or towards toward the proximal end of the rod. The rod further may further comprise a threaded tapered coupling at its proximal end operable to couple the rod to a directional drilling device by one or a series of extension rods that form a rod string. The bucket may further comprise a plurality of teeth operable to loosen the debris. If the end opening of the bucket opens toward the distal end of the rod, the bucket is operable to push debris out of the culvert, whereas if the end opening of the bucket opens toward the proximal end of the rod, the bucket is operable to pull debris out of the culvert.

A third tool for cleaning a culvert according to the invention is a brush comprising a rod having a center longitudinal axis and a center fluid-conducting channel, a plurality of bristles radially arranged about the rod, and at least one nozzle formed in the rod proximate to the plurality of bristles and operable to direct pressurized fluid into the culvert. The rod may have a threaded tapered coupling at its proximal end operable to couple the rod to one or more extension rods of a directional drilling device.

The invention further provides an apparatus for cleaning a culvert which comprises one of the above-described tools attached to the distal end of a series of extension rods forming a rod string, and a machine capable of pushing and pulling the tool and rod string as needed inside the culvert. Such a machine may comprising a directional drilling rig that also can rotate the rod string. A supply of high pressure water may be attached to the cleaning tool via the extension rods.

BRIEF DESCRIPTION OF THE DRAWINGS

Aspects of the present disclosure are best understood from the following detailed description when read with the accompanying figures. It is emphasized that, in accordance with the standard practice in the industry, various features may not be drawn to scale. In fact, the dimensions of the various features may be arbitrarily increased or reduced for clarity of discussion.

DETAILED DESCRIPTION

Figure 1A:
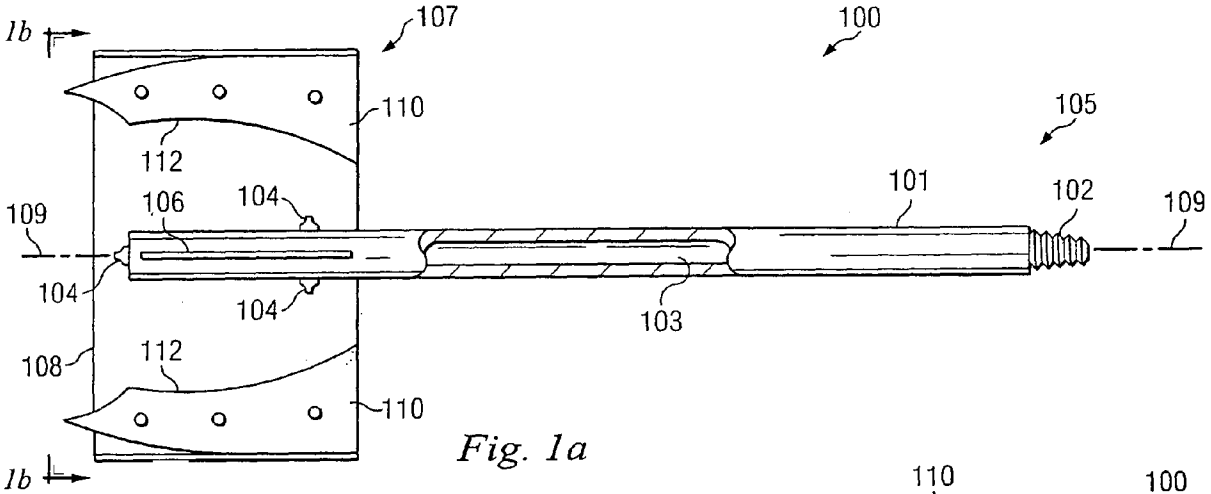
FIG. 1*a* is a cutaway view of a culvert cleaning tool.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 1B:
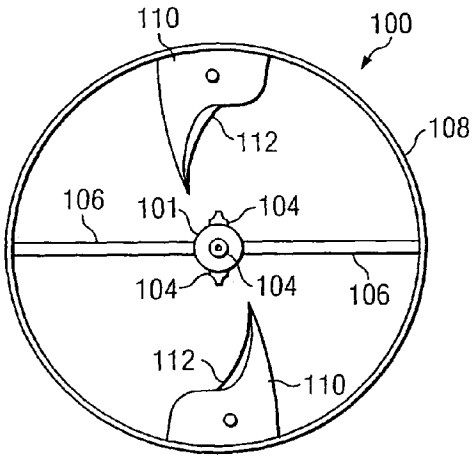
FIG. 1*b* is an end view of the culvert cleaning tool of FIG. 1*a*.

Referring to FIGS. 1*a*-*b*, a drill rod 101 having a proximal end 105 and a distal end 107 is couple to a substantially tubular housing 108 at its distal end 107. The drill rod 101 may have a length that is compatible for cleaning the length of a culvert to be cleaned. In one embodiment, the rod 101 may range between about 5 feet and 10 feet length and ranges from about 2 inches to about 2.5 inches in diameter. The rod 101 may be a commercially available drill rod section or may be custom made depending upon the needs of the user. The rod 101 may also be a commercially available pipe section or may be made from solid stock of steel, aluminum, or other metals or other suitable alloys thereof. In some applications plastics, polymers, fiberglass, or carbon fibers may also be used. The rod 101 comprises a coupler 102 at its proximal end 105 for coupling with an extension rod, a drilling rig or machine, or other available device, which is capable of performing horizontal or directional drilling. The coupler 102 may comprise a standard tapered threaded joint or some other type of coupling suitable for releasably attaching the rod 100 to an extension rod or to the drilling device. The coupling 102 may be integral with the rod 101 or attached as a separate component, by welding for example, and may be composed of similar materials as the rod 101. The rod 101 and the coupling 102 may have a fluid-conducting channel 103 defined therein to provide a means for introducing pressurized water, gases or other solutions into the culvert. One or more openings, nozzles or sprayers 104 in fluid communication with the channel 103 are formed in the distal end of the rod 104 to direct the pressurized fluids to the debris blocking the culvert.

The longitudinal central axis 109 of the drill rod 101 preferably coincides with the central longitudinal axis of the housing 108. The housing 108 may be substantially matched in diameter to the interior of the culvert being cleaned. For example, a tubular housing 108 may be chosen to approximately match the circular cross-section of certain culverts thus allowing a thorough cleaning in one pass. In some instances, however, with a large culvert, the housing 108 may be chosen to be smaller than the interior of the culvert to allow only portion of the culvert to be cleaned with each pass. In one embodiment, the diameter of the housing 108 may range from about 31 inches to about 48 inches and the length from about 14 inches to about 16 inches. The housing 108 may be made from a section of pipe of the appropriate diameter or may be custom made and may be composed of steel, iron, aluminum, or alloys thereof. If needed the housing 108 may also be made from plastic, polymers, or carbon fiber, for example.

The housing 108 may be coupled to the rod 101 by one or more supports 106. The supports 106 may extend radially from the rod 101 to the housing 108. Varying numbers of supports 106 may be used depending upon the application and needs of the user. The supports 106 may span the length of the tubular housing 108 but may also be shorter or longer. The supports 106 may be composed of similar or different materials than the housing 108 and rod 101. The supports may be coupled to the rod 101 and housing 108 by welds or by other means. As best seen in FIG. 1*b*, the housing 108 is secured to the rod 101 by two supports 106 spaced approximately 180.degree. apart from one another. Other configurations varying in position and number of supports are contemplated.

Figure 1C:
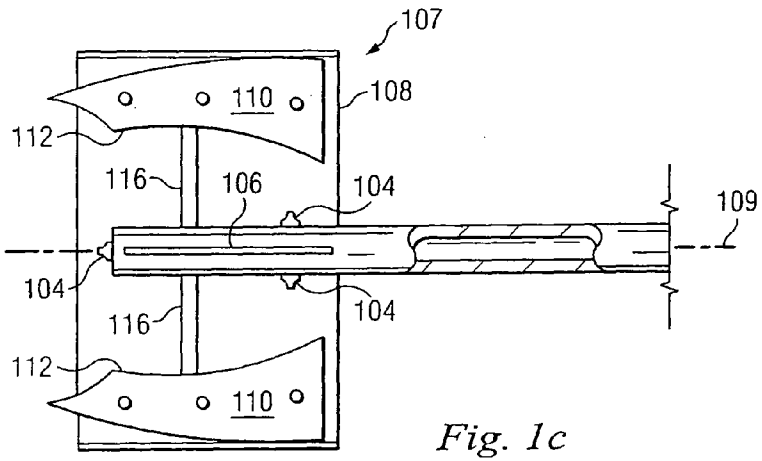
FIG. 1*c* is a side view, partly in section, of the culvert cleaning tool of FIG. 1*a*.

A plurality of cutting implements 110 are coupled to the inner surface of the housing 108. The cutting implements 110 may be bolted or welded to the housing 108, or secured by some other means. The tubular housing 108 may serve as an anchor point and partial covering for the cutting implements 110. In this way, the cutting implements 108 are kept safely away from the walls of the culvert or pipe as well as any liner that may be in place. The housing 108 may also serve to cover and protect nozzles 104 and to keep them from becoming stopped up or clogged. The cutting implements 110 may remain within the housing 108 or extend beyond the distal end of the housing 108 as shown in FIG. 1*a*. The cutting implements 110 coupled to the inner surface of the housing 108 rotate as the housing 108 rotates. The cutting implements 110 may also be coupled to the rod 101 and rotate with the rod 101 while the housing 108 remains stationary. For example as shown in FIG. 1*c*, the cutting implements 110 are coupled to the drill rod 102 by radial supports 116. The cutting implements 110 may be paddles designed to sweep debris in a particular direction in coordination with the direction of rotation of the housing 108. In other embodiments, the implements 110 may comprise a narrower or sharpened cutting edge 112. The cutting edge 112 may also be serrated or equipped with teeth as the needs of the user dictate. The cutting implements or paddles 110 may have cutting edges 112 pointing inwardly toward the drill rod 101.

The cutting implements 110 may be constructed of similar or different material than the housing 108 and rod 101. The cutting implements 110 may also comprise high carbon steel or another durable material. For example, the cutting edge 112 may be constructed of high strength material such as high carbon steel or other suitable materials. The shape and position of the cutting implements 110 may dictate whether debris is swept forward (e.g., out from the distal end 107) or rearward, toward the proximal end of the rod, as the needs of the application dictate. The design of the cutting implements 110 may also be such that debris may be swept either forward or rearward depending upon the direction of rotation of the housing 108 if the coupler 102 is designed to enable rotation in either direction. In FIG. 1*a*, the culvert cleaning tool 100 is shown with two cutting implements 110, but more or fewer implements may be utilized in other embodiments.

The jets, nozzles, or sprayers 104 may be coupled to the distal end 107 of the rod 101 at various points. The positions as shown in FIG. 1*a* include a plurality of nozzles 104 within the housing 108 pointing radially outward from the rod 101 and one nozzle 104 point axially away from the distal end 107 of the rod 101. This configuration illustrates one possible arrangement of the nozzles 104 but other configurations are contemplated. Similarly, other embodiments may have more or fewer nozzles 104, or none at all. The nozzles 104 may be configured to provide a high pressure fluid stream in a desired direction. The nozzles 104 may be attached to the rod 101 by gluing, welding, or other means, and may be composed of similar or different materials than the rod 101. The nozzles 104 may also be configured to provide a specific spray pattern such as a narrow stream or a wide angle spray. The nozzles 104 may be configured to spray only in a desired direction, for example, into the housing 108, away from the housing 108, or in some other direction from the rod 101, which may increase the debris removal efficiency of the cleaning tool 100.

In operation, the culvert cleaning tool 100 may be used to clean a culvert, culvert pipe, drainage ditch, or other elongated and confined area that has become clogged with debris. The cleaning tool 100 (FIG. 1*a*) may be attached to a horizontal drilling device (not shown) by coupler 102 and, optionally, one or more extension rods which form a rod string. If the device 100 is equipped with nozzles 104, a high pressure supply of cleaning fluid may be attached to the rod 101. A water tank with a pump may be used as the water supply. In some cases, the directional drilling machine may supply water to the nozzles 104 by pressurizing the water inside the rod 101 as previously described. The water nozzles may be checked for proper function and to ensure there is no blockage.

The cleaning tool 100 having been selected for size and for direction of debris removal may be inserted into the culvert. The drilling machine rotates the tool 100 within the culvert while injecting the pressurized water. The cutting implements 110 rotate with the housing 108 or rod 101 in a predetermined direction. In certain implementations where the coupler 102 is a threaded coupling, the housing 108 may be rotated clockwise to prevent the threaded coupling from loosening. Debris that is cut or dislodged will be deflected in the appropriate direction by cutting implements 110. The process may be repeated such that the device 100 is worked within the culvert in a "back and forth" motion until the culvert has been sufficiently cleaned. The nozzles 104 may be activated to assist with loosening of the debris and with debris removal by providing lubrication and pressurized force thereon. In some instances, the rod 101 may not provide sufficient length to clean the entire culvert. In such case, extension joints or tubing (not shown) that is compatible with the coupling 102 of the rod 101 and the drilling machine may be attached to coupling 102.

Figure 2A:
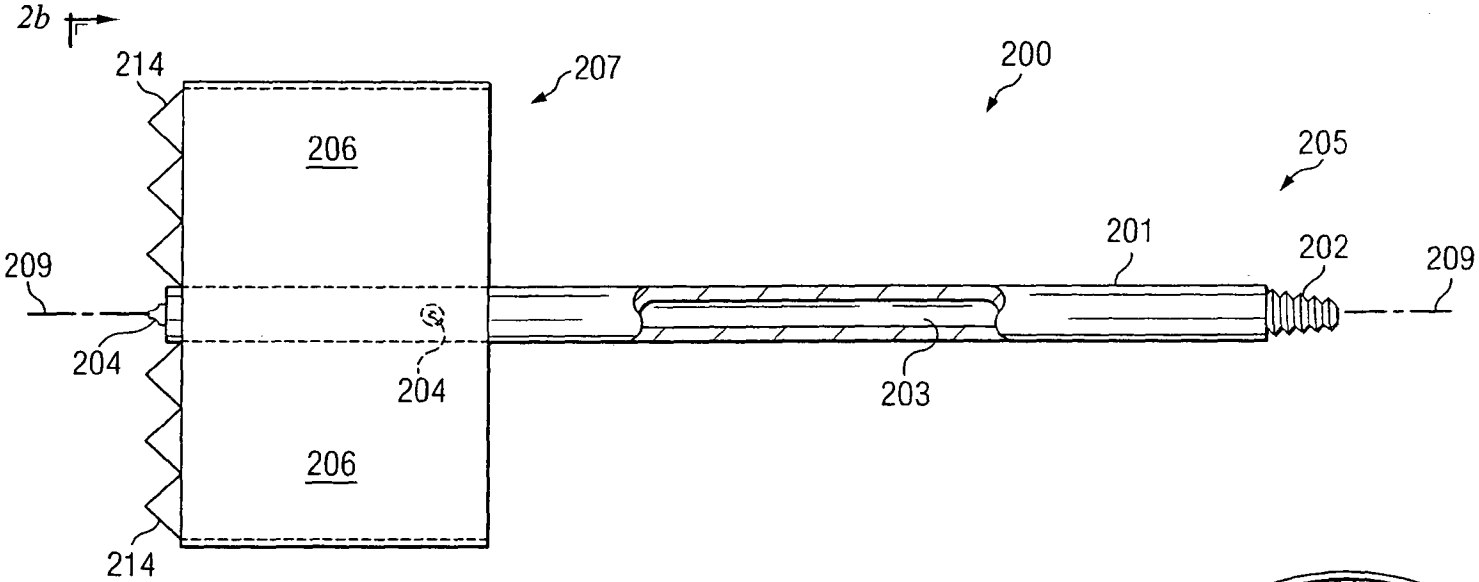
FIG. 2*a* is a cutaway view of another culvert cleaning tool.
Figure 2B:
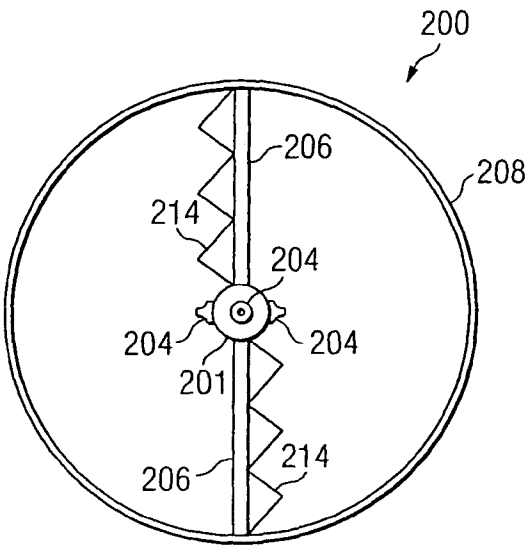
FIG. 2*b* is an end view of the culvert cleaning tool of FIG. 2*a*.

FIG. 2*a* is a cutaway view of another embodiment of a culvert cleaning tool 200 and FIG. 2*b* provides and end view of the same. The culvert cleaning tool 200 comprises a drill rod 201 with a coupling 202 at a proximal end 205 thereof. The rod 201 may have a length that is compatible for cleaning the length of a culvert and may be joined to one or more extension rods (not shown) for extending the reach of the tool. The rod 201 may range between about 5 feet and 10 feet length and ranges from about 2 inches to about 2.5 inches in diameter. The rod 201 may be a commercially available drill rod section or may be custom made depending upon the needs of the user. The rod 201 may also be a commercially available pipe section or may be made from solid stock of steel, aluminum, or other metals or other suitable alloys thereof. In some applications plastics, polymers, fiberglass, or carbon fibers may also be used. The rod 201 may comprise a channel 203 to allow pressurized fluids, such as water, gases, or other solutions to be conducted therethrough while the device 200 is in operation. The coupling 202 may be a tapered threaded joint or another type of coupling. The rod 201 and the coupling 202 may be integral or formed as separate pieces and attached together. The coupling 202 may also be hollow to allow the introduction of pressurized fluids into the rod 201. One or more nozzles 204 provided at various locations on the rod 201 are in fluid communication with the channel 103 of the rod 201 to conduct pressurized fluids to aid in debris removal.

The rod 201 is coupled by radial supports 206 to a housing 208. The rod 201 may be coupled coaxially along a center longitudinal axis 209 to the longitudinal axis of the housing 208. The housing 208 may serve to cover and protect nozzles 204 and to keep them from becoming stopped up or clogged. The tubular housing 208 may be chosen to approximately match the circular cross-section of certain culverts thus allowing a thorough cleaning in one pass. In some instances, however, with a large culvert, the housing 208 may be chosen to be smaller than the interior of the culvert to allow only portion of the culvert to be cleaned with each pass. In one embodiment, the diameter of the housing 208 may range from about 31 inches to about 48 inches and the length from about 14 inches to about 16 inches. The housing 208 may be made from a section of pipe of the appropriate diameter or may be custom made and may be composed of steel, iron, aluminum, or alloys thereof. If needed, the housing 208 may also be made from plastic, polymers, or carbon fiber, for example.

The tool 200 also comprises a plurality of forward-pointing teeth 214 to provide cutting surfaces for clearing and cutting debris. A series of cutting teeth 214 is attached to the supports 206 to aid in loosening and removing debris. The teeth 214 may be formed integrally with the supports 206 or they may be coupled thereto separately. The teeth 214 may be made of a durable material such iron, steel, aluminum, or alloys thereof. The teeth 214 may also be made from a high carbon steel, carbide, or diamond tipped for even greater durability. The teeth 214 and supports 206 may be constructed such that the teeth 214 protrude beyond the housing 208 at the distal end 207. Thus, the teeth 214 are exposed to blockage in the culvert while the walls of the culvert remain protected by the housing 208. The teeth 214 may attach at an angle to the supports 206 to improve cutting characteristics and to deflect debris in a desired direction as it is cut. There may be more or fewer teeth 214 than shown here as well as more or fewer supports 206. The angle of the teeth 214 may be configured such that rotation in a specific direction by the housing 208 results in more efficient cutting and debris deflection. It is also contemplated that various characteristics of the embodiments disclosed herein may be incorporated or utilized together. For example, culvert cleaning tool 100 may comprise teeth 214 on its supports 106 as shown in FIG. 1*a*-1*b*.

In operation, the cleaning tool 200 may be coupled to a directional drilling machine and to a high pressure water source. The cleaning tool 200 may be inserted into the culvert into contact with debris to be removed. The drilling machine then rotates the cleaning tool 200 to commence clearing debris. The teeth 214 may cut through dirt, rocks, plants roots, animal nests, or other debris while moving forward and rotating. As before, this process may be repeated such that a back and forth motion is accomplished to ensure proper cutting of the debris and clearing of the culvert. One or more extension rods may be coupled to the drill rod 201 to extend the reach of the tool 200 into the culvert. The nozzles 214 may be activated to provide additional cleaning power or to assist in sweeping debris in a desired direction. Debris may be either pushed forward away from the device 200 or drawn towards the original opening depending upon the needs of the cleaning project. Additionally, the cleaning tool 200 may be used alternately with the cleaning tool 100 described above if needed.

Figure 3A:
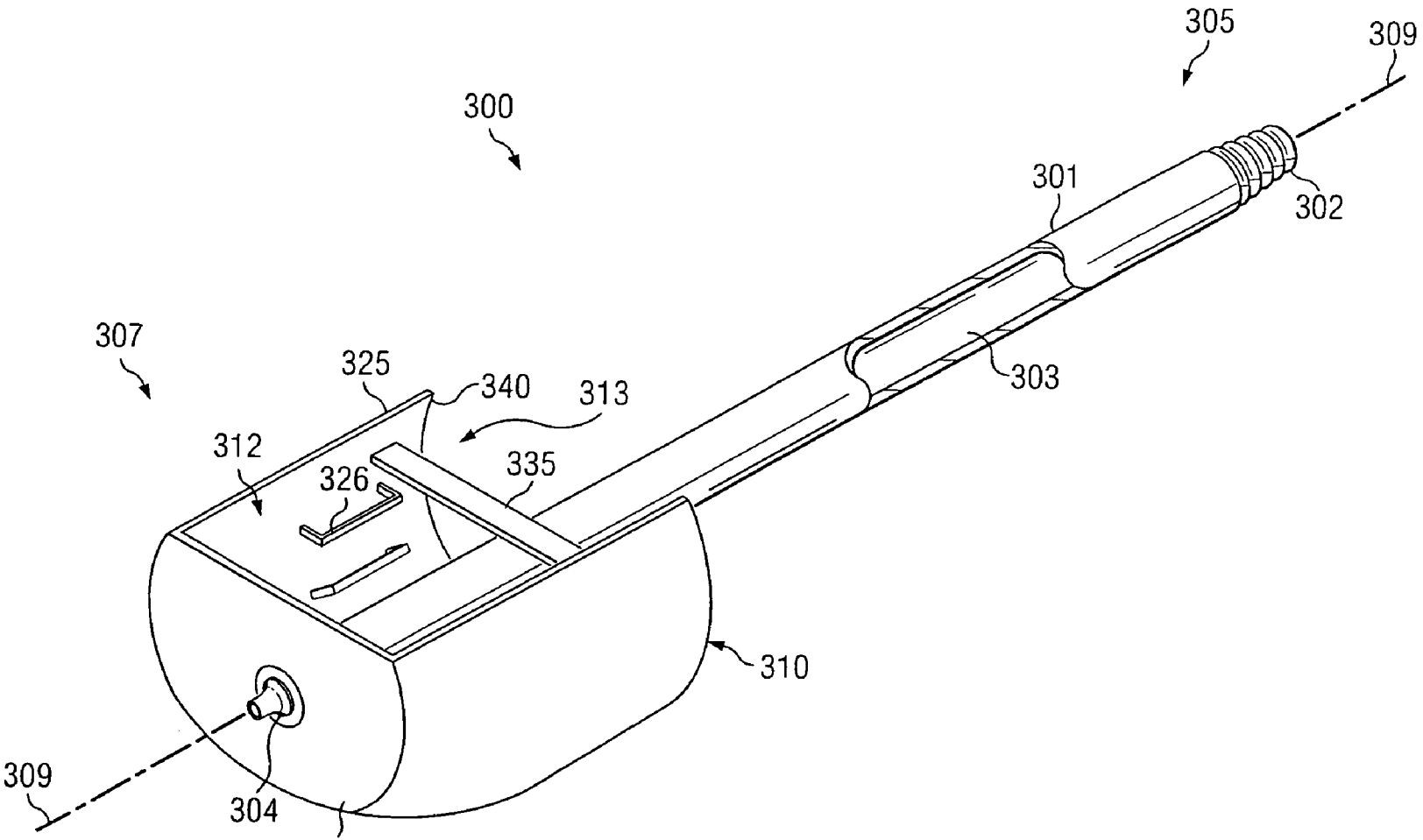
FIG. 3*a* is a perspective view of another culvert cleaning tool.
Figure 3B:
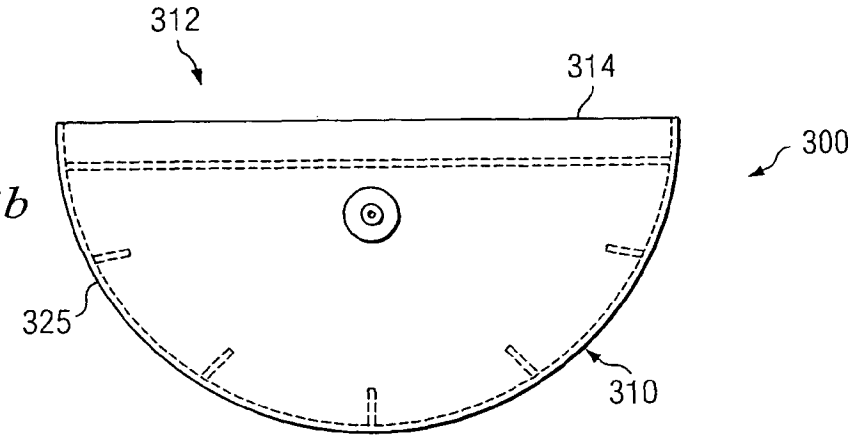
FIG. 3*b* is a side view of the culvert cleaning tool of FIG. 3*a*.
Figure 3C:
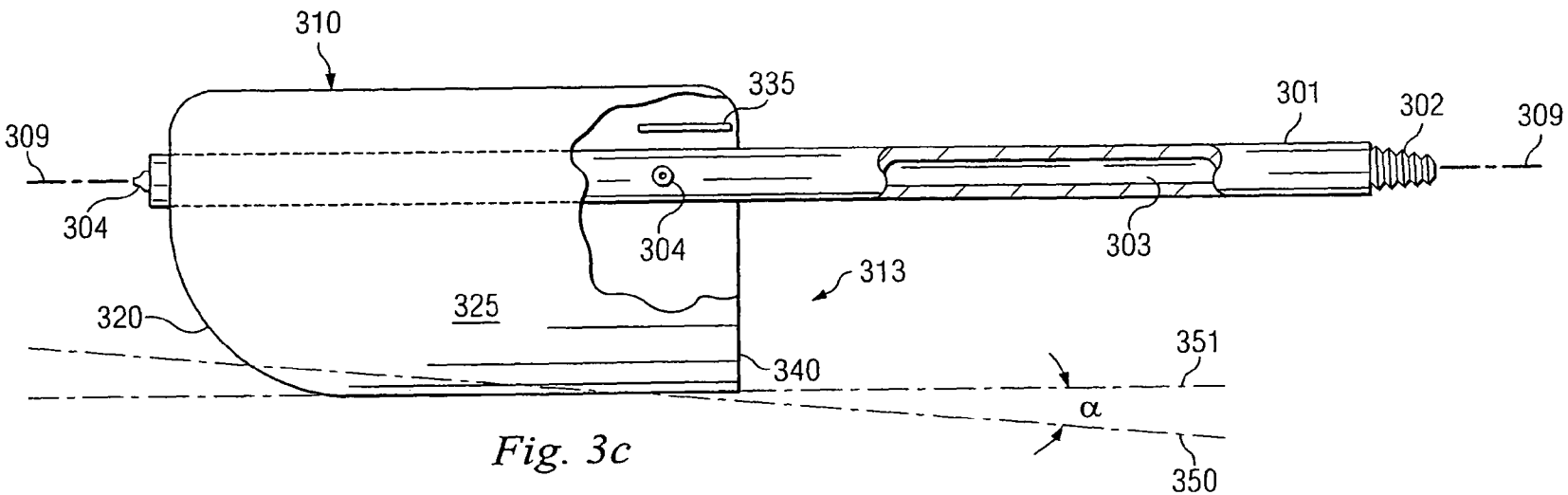
FIG. 3*c* is a side view of the culvert cleaning tool of FIG. 3*a* with alternate cutting implement placement.

FIG. 3*a*-3*c* presents various views of another embodiment of a culvert cleaning tool 300. The cleaning tool 300 is a "pull bucket" and comprises a drill rod 301 with a proximal end 305, a distal end 307 and a longitudinal axis 309 therethrough. The drill rod 301 may have a length that is compatible for cleaning the length of a culvert and may be joined to one or more extension rods (not shown) for extending the reach of the tool. The rod 301 may range between about 5 feet and 10 feet length and may range from about 2 inches to about 2.5 inches in diameter. The rod 301 may be a commercially available drill rod section or may be custom made depending upon the needs of the user. The rod 301 may also be a commercially available pipe section or may be made from solid stock of steel, aluminum, or other metals or other suitable alloys thereof. In some applications plastics, polymers, fiberglass, or carbon fibers may also be used. The rod 301 may comprise a channel 303 to allow pressurized fluids, such as water, gases, or other solutions to be conducted therethrough while the device 300 is in operation. The coupling 302 may be a tapered threaded joint or another type of coupling. The rod 301 and the coupling 302 may be integral or formed as separate pieces and attached together. The coupling 302 may also be hollow to allow the introduction of pressurized fluids into the rod 301.

Optionally, the drill rod 301 may comprise one or more nozzles in fluid communication with the fluid-conducting channel 303 in the rod 301. The nozzles 304 may direct pressurized fluids into the culvert to aid in debris removal.

The drill rod 301 is coupled to a c-shaped scoop or bucket 310 defined by an end portion 320, sidewalls 325 with a plurality of catches 326, and a rearward rim 340. The sidewalls 325 of the bucket 301 do not meet and therefore define a side opening 312. Further, the bucket 301 defines a rearward opening 313 opposing the end portion 320. The end portion 320 and walls floor 325 may be made from iron, steel, or other materials. The end portion 320 and side walls 325 may also be made from other materials such as plastics or polymers if desired. The rod 301 may attach directly to the end portion 320 may pass therethrough to allow placement of an additional nozzle 304, for example. The end portion 320 may include a substantially flat plate having an appropriate shape for the bucket 310. The end portion 320 and/or sidewalls 325 may one or more pieces welded or otherwise joined together. In other embodiments, the rod 301 may be coupled to the bucket 310 at a different location, such as along the sidewall 325 opposite the bucket opening 312, for example.

A support 335 may be coupled across the bucket opening 312 opposite the end portion 320 to increase the structural integrity and load capacity of the cleaning tool 300. The support 335 may attach, by welding, for example, to the side walls 325 and pass over or under the rod 301. The support 335 may also be secured to the rod 301 such as by welding. In other embodiments, the cleaning tool 300 may comprise different or additional supports than the support 335 as shown.

In particular, referring to FIG. 3*b*, the bucket 310 may comprise sidewalls 325 that form an arc in cross-section with the lateral opening 312 formed by a chord 314 connecting the circumference of the bucket cross-section. The distal end of the bucket 310 is covered by the end portion 320 and the proximal end of the bucket 310 defines a rearward opening 313. In one embodiment, the diameter of the bucket cross-section may range from about 14 inches to 17 inches and the length from about 20 inches to 25 inches. The sidewalls 325 may be formed from a large pipe section or may be custom made in the shape desired. The sidewalls 325 may be formed integrally or separately and then assembled, by welding, for example. There may also be a series of catches or ribs 326 along the sidewalls 325 which may serve to prevent debris captured in the bucket from sliding out easily. The catches 326 may be made from iron, steel, or another suitable material.

As more clearly seen in FIG. 3*c*, the end portion 320 of the bucket 310 may have a curved profile. The curved forward profile of the bucket 310 may be advantageous for facilitating the advancement of the tool 300 into the culvert. It may also be seen that in this embodiment the rod 301 extends through the end portion 320. The floor 325 of the bucket 310 is shown in this embodiment as being substantially parallel to the rod 301. That is, the central axis 309 of the drill rod 301 is parallel to an axis 351 of the floor 325 of the bucket 310. However, the cleaning tool 300 may also be assembled to provide a tilting of the bucket floor 325 relative to the rod axis 309 by a predetermined angle .alpha. In this way, the rearward edge 340 of the bucket 310 is presented at an angle against the walls of the culvert to enhance the ability of the tool 300 to remove debris. The angle .alpha. may vary depending on the needs of the cleaning project.

Figure 4:
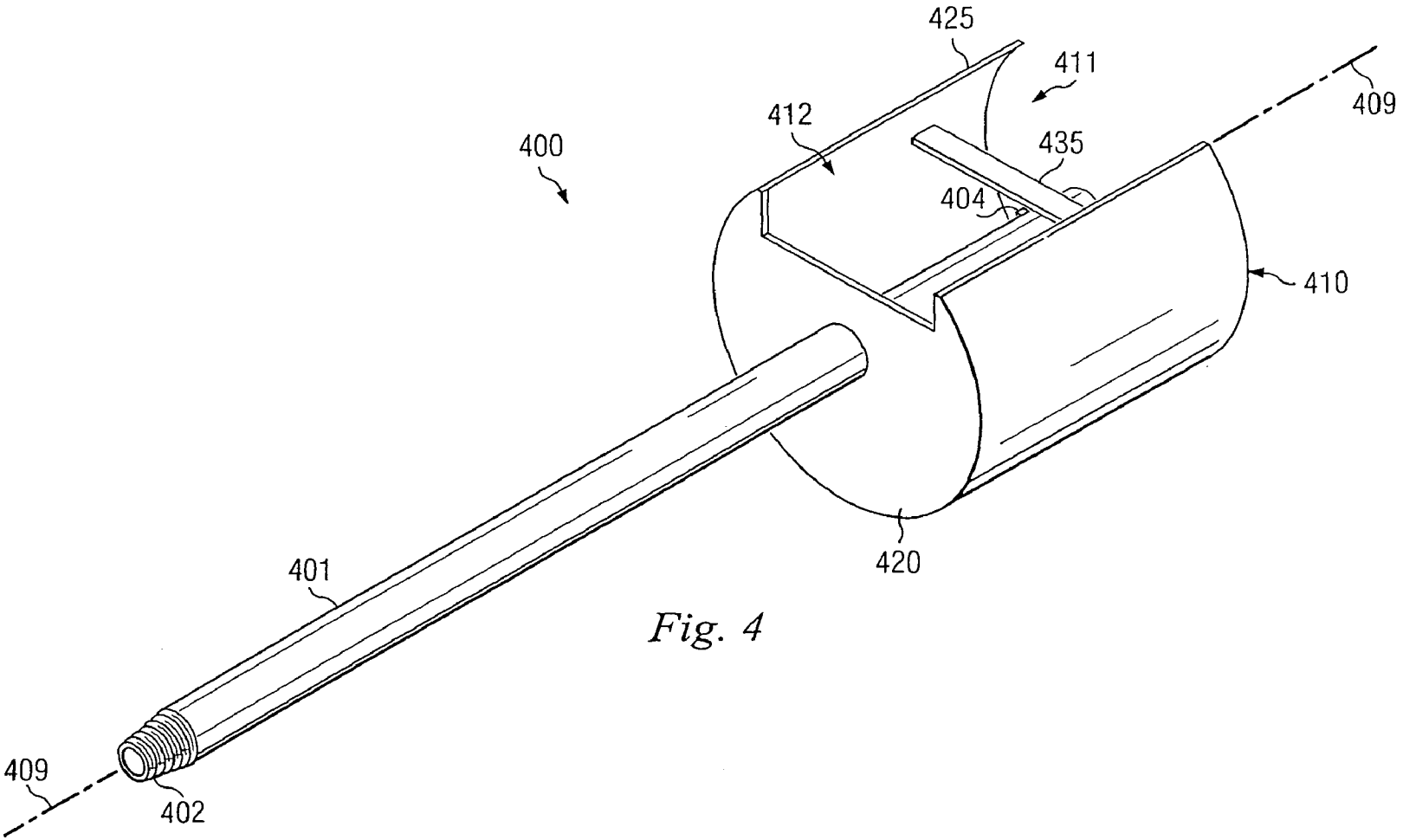
FIG. 4 is a perspective view of another culvert cleaning tool.

FIG. 4 is a perspective view of another embodiment of a culvert cleaning tool 400. Culvert cleaning tool 400 is a "push bucket" that is operable to push debris encountered in the culvert forward toward the distal end of the culvert. Cleaning tool 400 comprises a bucket 410 with a forward opening 411 and a side opening 412 coupled to drill rod 401. The push bucket 400 may comprises the same features as the pull bucket 300 described above. The floor and sides 425 of the tool 400 may also be tilted relative to the central axis 409 to increase cleaning efficiency.

Figure 5:
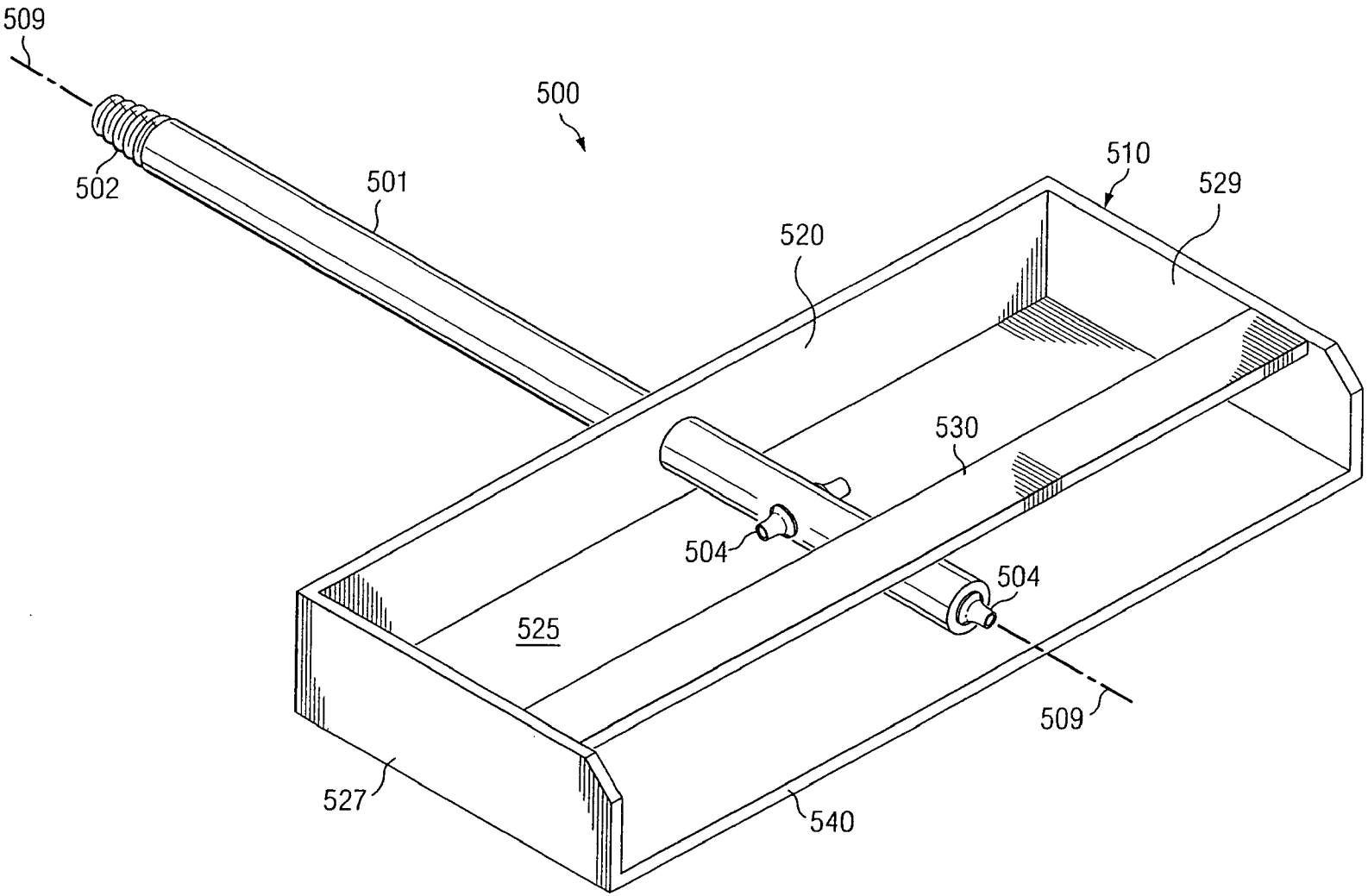
FIG. 5 is a perspective view of another culvert cleaning tool.

FIG. 5 is a perspective view of another embodiment of a culvert cleaning tool 500. The tool 500 comprises a bucket 510 with a generally rectilinear shape. The bucket 510 comprises a substantially flat end portion 520 through which a drill rod 501 passes, a substantially flat floor 525, and substantially flat sides 572, 529. The end portion 520, floor 525, and sides 527, 529 may be formed integrally or as separate pieces joined together, by welding, for example. In one embodiment, the rod 501 may be coupled to the bucket 510 on the floor 525 or in a different location. The flat floor 525 provides a flat scooping or scraping edge 540. The flat floor 540 and flat sides 527, 529 may join at right angles and thus define a substantially rectilinear-shaped scoop. The floor 525 of the tool 500 may be parallel to the central axis 509. However, in some embodiments, the floor 525 may be angled relative the central axis 509 to provide for more efficient gathering of debris when the device 500 is pushed within a culvert. Supports, such as support 530 may also be provided to increase load capacity or improve stability of the tool 500, for example. In another embodiment, the open end of the scoop will face toward the coupling 502, so as to allow the scoop to operate by being drawn or pulled rather than pushed.

In operation, the scoop or bucket-type cleaning tools 300, 400, 500 may be used to clean a culvert, culvert pipe, drainage ditch, or another elongated and confined space that has become clogged with debris. The tools 300, 400, 500 may be used to remove rocks or other large debris as well as debris that may be very dense or heavy, or is otherwise more effectively removed with a scooping tool than a rotating tool, such as tool 100. A tool (300, 400, 500) may be chosen based upon whether it is appropriate to push the debris out of the distal opening or draw it back out of the proximal opening of the culvert. Environmental concerns and the elevation and siting of the culvert openings may be determinative factors. The interior shape and dimensions of the culvert may also be considered. For example, in a culvert with a flat bottom, the rectilinear tool 500 may be used, whereas a round culvert may be most effectively cleaned with one of the cylindrical tools 300 and 400. As before, the size of the tool 300, 400, 500 may be chosen to match the clearance in and around the culvert or based on other user preferences.

The chosen tool (300, 400, or 500) may be attached to a directional drilling machine and extension pieces or tubing may be used if needed. If water nozzles (304, 404, or 504, respectively) are provided or needed, a high pressure water supply may then be attached to the tool 300, 400, 500 and the water nozzles tested for blockage and proper operation. The tool 300, 400, 500 may then be inserted into the culvert to a desired location. The orientation of the tool 300, 400, 500 relative to the interior of the culvert, or relative to the debris to be removed, may be adjusted by partial rotations of the tool 300, 400, 500 by the drilling machine. As the tool 300, 400, 500 is worked into the culvert, partial rotations may also be used to clear obstacles or structures within the culvert that may not be removable.

When the tool 300, 400, 500 has been inserted to the proper location, the floor 325, 525 of the tool 300, 400, 500 may be rotated towards the debris and the tool 300, 400, 500 may be positioned to scoop or scrape the debris in a desired direction. If the tool 300, 400, 500 becomes overly full, it may be lifted from the debris and removed from the culvert. The tool 300, 400, 500 may then be rotated to an "upside down" position to allow the debris to fall out or be removed. The tool 300, 400, 500 may then be reinserted and the process repeated until the culvert has been sufficiently cleaned. Water jets 304, 404, 504 may be used to assist in debris removal, for example by softening debris, or by sweeping it in a desired direction. In some cases, the debris in the culvert may need to be churned or loosened to allow ease of removal. The bucket or scooping tool 300, 400, 500 may be placed on or near the debris and rotated by the drilling machine to effect the desired mixing or churning action. Water jets 304, 404, 504 may be used here also if needed to increase the effectiveness of the operation. The bucket or scooping tools 300, 400, 500 may also be used in conjunction with the rotating tools 100, 200. One or more extension rods may be used with the tools 300, 400, and 500 to extend the reach of the tool inside the culvert.

Figure 6A:
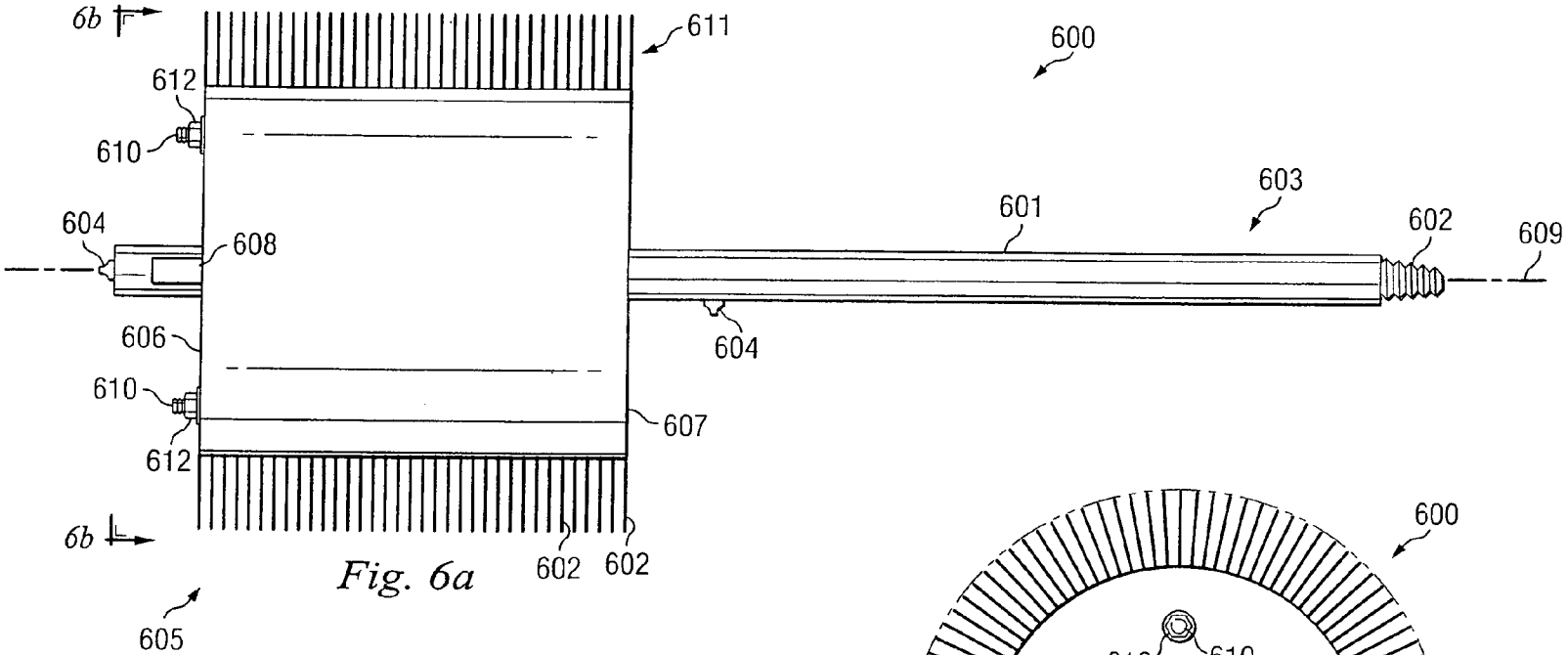
FIG. 6*a* is a side view of a culvert cleaning brush.
Figure 6B:
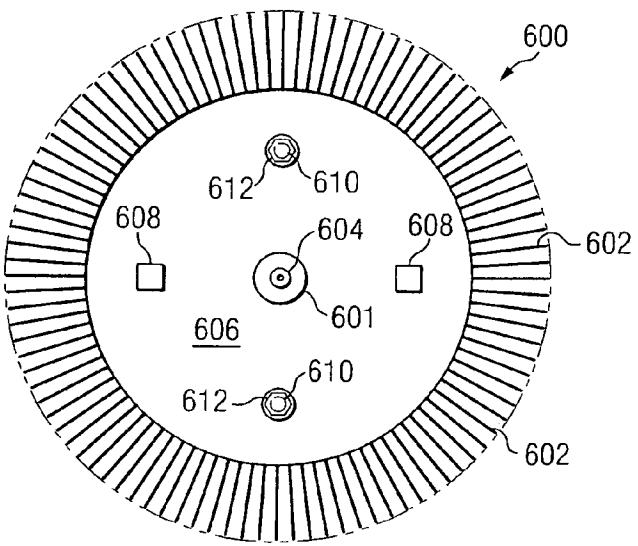
FIG. 6*b* is an end view of the culvert cleaning brush of FIG. 6*a*.

FIG. 6*a* is a side view of a culvert cleaning brush tool, or finishing brush tool 600. FIG. 6*b* is an end view of the brush tool 600. The brush tool 600 has a drill rod 601 with a proximal end 603 and a distal end 605. The proximal end 603 comprises a coupling 602, which may be a tapered threaded coupling or another suitable coupling. The rod 601 may comprise a fluid conducting channel and one or more fluid nozzles 604 at or near its distal end 605. The brush tool 600 comprises a brush assembly 611. The brush assembly 611 may comprise a plurality of brush segments 602 arranged concentrically about the rod 601. In one embodiment, brush segments 602 may range from about 30 inches to about 36 inches in diameter and may be about 2 inches in length. The brush segments 602 are sandwiched together by a forward end plate 606 and a rearward end plate 607. One or more drive rails 608 may be mounted to the rearward end plate 607 and are operable to pass through one or more corresponding openings in the forward end plate, as seen in FIG. 6*b*.

The forward end plate 606 may comprise steel, iron, aluminum, or another suitable material. In FIG. 6*b*, it may be seen that the drive rails 608 may be rectilinear in shape, but they may be cylindrical or other shapes. Although, two drive rails 608 are shown equidistant from the rod 601 and offset 180.degree. from one another, there may be more or fewer drive rails and their positions may differ from those shown. Similarly, there are two sets of threaded bars 610 and fasteners 612. The threaded bars 610 may be made from standard bolts if the desired length of bolt is available, or the threaded bars 610 may be made from commercially available all-thread, for example. The fasteners 612 may be threaded nuts or other devices for holding the brush segments together. In another embodiment, the fasteners 612 may be cotter pins for use with a hole (not shown) in the bolt 610, for example. In yet another embodiment, the threaded bars 610 may not be necessary if, for example, the end plate 606 is welded directly to the mounting bars 608.

Figure 6C:
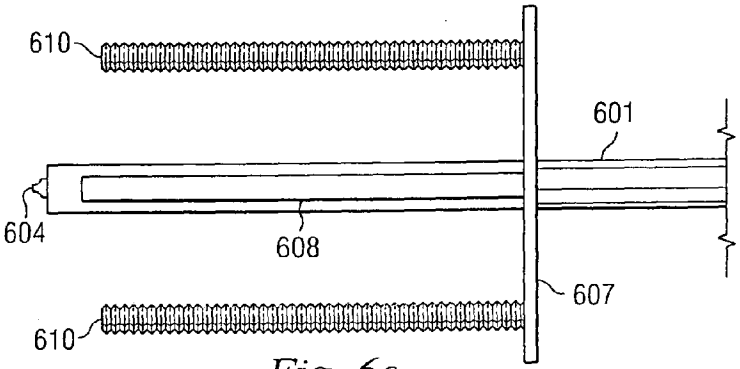
FIG. 6*c* is a partially disassembled view of the culvert cleaning brush of FIG. 6*a*.

FIG. 6*c* is a partially disassembled view of the culvert cleaning brush 600 of FIG. 6*a*. A portion of the rod 601 is shown with a nozzle 604. The rearward end plate 607 is shown in position and may be attached to the rod 601, for example, by welding. The end plate 607 may be substantially similar in composition and dimension as forward end plate 606. Drive rails 608 and threaded bars 610 may be coupled to the end plate 607, by welding, for example.

Figure 7:
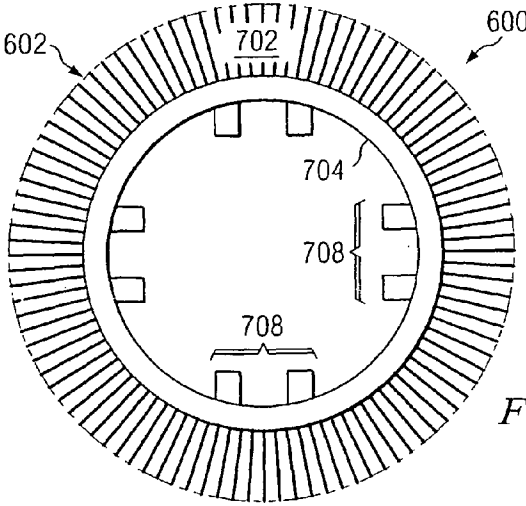
FIG. 7 is a top view of a brush section.

FIG. 7 is a top view of a brush segment 602. Bristles 702 may be coupled to a mounting ring 704. The mounting ring 704 may have a series of fingers 708 spaced around the inner circumference of the ring 704 so as to engage the mounting bars 608, and threaded bars 610 (FIGS. 6*a-c*). The bristles 702 may be made of nylon, or some other suitable synthetic or natural material. The mounting ring 704 may be made of plastic, a metal, or another suitable material. The fingers 708 may likewise be composed of a plastic, metal, or other suitable material. The diameter of the bristled portion 702 of the brush segments 602 may range from about 18 inches to about 36 inches, while the diameter of the inner ring may range from about 8 inches to about 12 inches. The thickness of the brush segment 602 may be about one inch. In one embodiment of the device 600 (FIGS. 6*a-c*), the drive rails 608 and threaded bars 610 are mounted to the end plate 607 in such a manner as to provide the proper spacing and radius that commercially available street sweeper sections may be used as the brush segments 602.

Figure 8A:
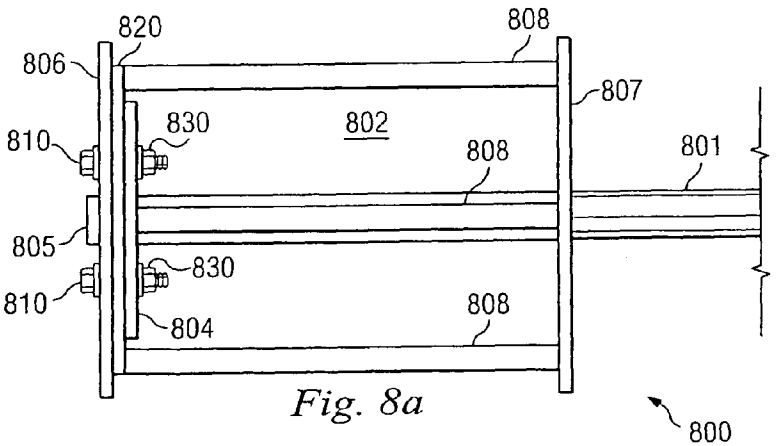
FIG. 8*a* is a transparent view of another culvert cleaning brush.

FIG. 8*a* is a transparent view of another embodiment of a culvert cleaning brush 800. The brush 800 is built onto a rod 801, which may have a length that is compatible for cleaning the length of a culvert and may be joined to one or more extension rods (not shown) for extending the reach of the tool. The rod 801 may range between about 5 feet and 10 feet in length and ranges from about 2 inches to about 2.5 inches in diameter. The rod 801 may be a commercially available drill rod section or may be custom made depending upon the needs of the user. The rod 801 may also be a commercially available pipe section or may be made from solid stock of steel, aluminum, or other metals or other suitable alloys thereof. In some applications plastics, polymers, fiberglass, or carbon fibers may also be used. The rod 801 may comprise a channel 803 to allow pressurized fluids, such as water, gases, or other solutions to be conducted therethrough while the device 200 is in operation. In this embodiment, a multidirectional nozzle 805 is shown but other nozzles (e.g. 104 or FIG. 1) may be used and may be interchangeable with nozzle 105. The nozzle may be in fluid communication with the channel 803 in the rod 801.

Culvert cleaning tool 800 may also comprise end plates 804 and 806 to hold the brush segments together. However, a rod brace 802 may be utilized as a base for mounting drive rails, mounting bars, or splines 808. The rod brace 802 may be made of a pipe section of constructed from suitable materials such as a metal or plastic. The length and diameter of the rod brace may be selected to match the interior of the brush segments 602 described above. The drive rails 808 may be attached directly to the rod brace 608, by welding, or bolting for example. As shown, the end plates 804, 806 in combination with the rod brace 800 may provide a solid substantially cylindrical surface, to which brush sections 602 may be mounted. The drive rails 808 may be arranged to as to interface with the fingers 708 of brush section 602 (FIG. 7). The end plate 806 may be held in place by flange plate 804 which may be welded to the rod 801 for example. Captive nuts 830 on the flange plate 804 may be used for ease of assembly. Bolts 810 or other suitable fasteners may provide fastening on the opposite side. One or more washers may be used at various locations on the device 800. For example, rubber washer 620 may be used to prevent leakage of mud, water, or debris into the interior of the rod brace 802 when the device 800 is assembled for use.

Figure 8B:
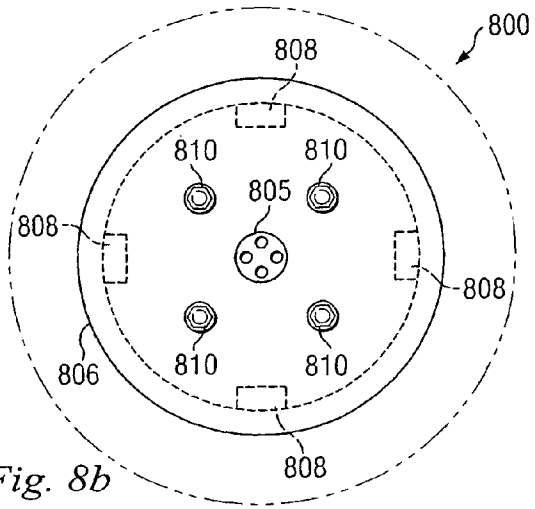
FIG. 8*b* is an end view of the culvert cleaning brush of FIG. 8*a*.

FIG. 8*b* is an end view of the culvert cleaning brush 800 of FIG. 8*a*. In this view, one possible configuration for the drive rails 808 can be seen but others are possible. As in previous embodiments, the drive rails may be positioned according to the design of the brush sections 802, possibly allowing commercially available street sweeper brush sections to be used. One possible bolt pattern for bolts 810 can also be seen here. The bolts 810 may be patterned to match the flange plate 831 (FIG. 8*a*), but other configurations than shown here are possible. Multidirectional nozzle 805 is also shown here which, in this embodiment, attaches directly to the end of rod 801. The multidirectional nozzle may allow for multiple high pressure fluid streams from a single location on rod 801.

In operation, the culvert cleaning brush 600 or 800 may be coupled to a piece of equipment such as a directional drill capable of drilling horizontally. The size of the brush used may be chosen to correspond the size of the culvert being cleaned. As before, extension rods may be added to the drill rod to increase the effective reach of the brush. The brush may also be attached to a high pressure water source (e.g., the drilling machine) so that the water nozzles 604, 805 may be used to aid in the cleaning. The nozzles 604, 805 may aid by sweeping the debris in a desired direction (e.g., away from the drilling machine, or towards it) or by softening hardened debris for easier sweeping. As described in greater detail below, the brushes 600, 800 may be used as part of a cleaning process that may involve first using other tools that have been described herein.

Figure 9:
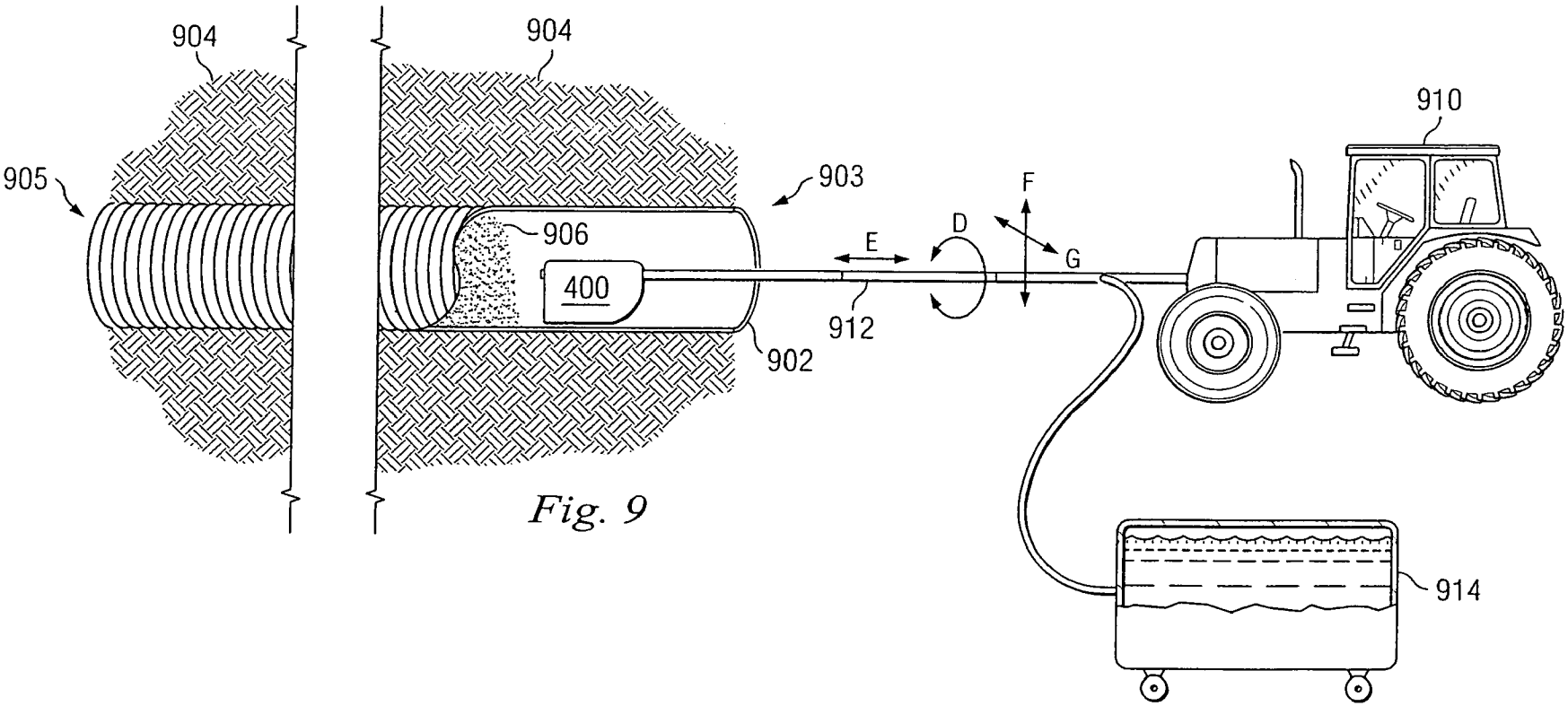
FIG. 9 is a view of one possible environment in culvert cleaning tools of the present disclosure may operate.

FIG. 9 is a view of one possible environment 900 in which embodiments of the above-described tools may operate. An underground pipeline may be a culvert 902 passing under a roadway 904. The culvert 902 has a proximal end 903 and a distal end 905. Depending on environmental and other factors, the proximal end 903 or the distal end 905 may be selected as the debris exit point from the culvert 902. Preferably the culvert end having the lower elevation is chosen as the debris exit point in order to take advantage of the force of gravity, but this selection is not required. The debris 906 may partially or fully block the culvert 902. As shown, the proximal end 903 of the culvert 902 is accessible to a directional drilling machine or rig 910. Removal of grating or other safety implements (not shown) to expose the proximal opening of the culvert may be necessary, as well as excavation of the immediate area to allow proper access to the culvert 902.

In this example, the cleaning tool 400 (as in FIG. 4) is shown attached to a drill rod of the drilling rig 910. One or more extension rods 912 may be joined end to end with threaded male and female couplings as shown to form a rod string to increase the effective reach of the tool 400. As stated previously, a high pressure water supply 914 may also be attached to the cleaning tool 400, via the extension rods 912, for example. The drilling rig 910 may manipulate the cleaning tool 400 in such a manner as to effect removal of the debris 906. The drilling rig 910 may be able to supply movement to the cleaning tool 400 along several different axes as shown by arrows D, E, F, and G. Depending upon the tool attached to the rig 910, the debris may be pushed or pulled from the proximal end of the culvert by driving drilling rig 910 toward or away from the proximal end 903 of culvert 902 as shown in FIG. 9.

Figure 10:
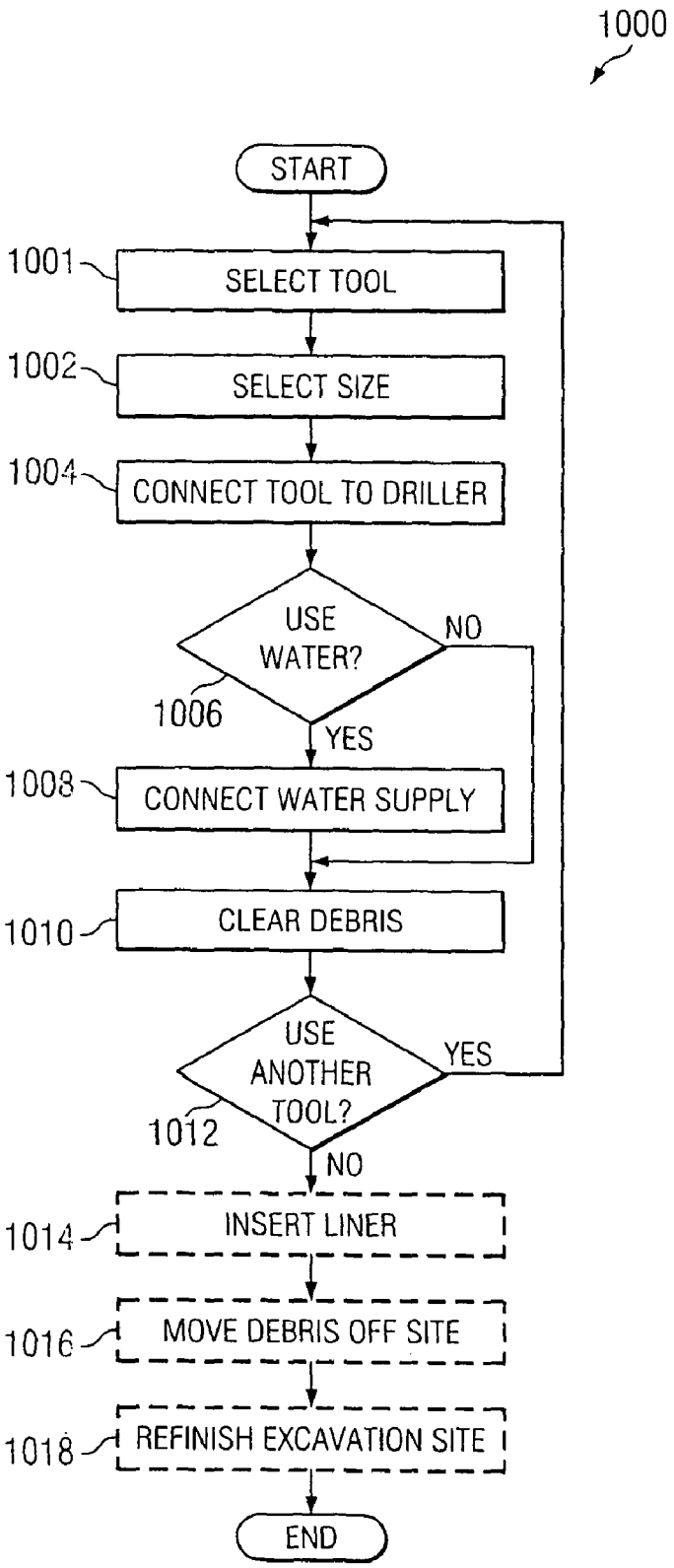
FIG. 10 is a flow chart illustrating a method for cleaning a culvert.

FIG. 10 is a flow chart of one embodiment of a method for cleaning a culvert. The appropriate tool may first be selected at step 1001. The cleaning tools as previously described may be chosen depending upon the type of debris in the culvert, the size and location of the culvert, and environmental factors, for example. Once an appropriate tool has been chosen, an appropriate size may be selected at step 1002. The size of the tool needed may depend upon the size of the culvert and whether a portion or all of the culvert is to be cleaned in each pass of the tool. Additionally the type of debris may impact the choice of the size of the tool. For example, very dense debris may lead to a selection of a smaller tool to reduce weight in the tool. A culvert with an immovable obstacle inside may lead to the selection of a smaller size tool to enable adequate room to maneuver the tool inside the culvert.

One an appropriate tool and size has been selected, the tool may be connected to a drilling machine at step 1004, such as a horizontal drilling rig. The connection of the tool to the drilling rig may also involve the use of extension joints as previously described. If water is to be used to assist in the cleaning at step 1006, the water supply is connected at step 1008. In some embodiments, the drilling rig may also serve as a high pressure pump or water supply. Clean water may be used in some embodiments but waste water, water from a local body of water, or another supply of a suitable liquid may also be used. At step 1010, the tool may be inserted into the culvert and the cleaning action may commence. As previously described and depending upon the tool currently in use, drilling motions, sweeping motions, or scooping motions may be used to clear debris from the culvert. Additionally, it may be necessary for debris to be deposited only in one area as it is removed from the culvert. Environmental concerns, for example, may necessitate that removed debris is placed only at one end of the culvert and/or that the fluids used in loosening the debris not enter an existing natural body of water.

In some environments, the cleaning of a culvert may require the use of more than a single tool. For example, a scooping-type tool may be used, followed by a brush. In some embodiments, two different kinds of routing or rotating tools may be used followed by a brush tool. Some culverts may require the use of both scooping tool and routing tools followed by the brush tool, and some cleanings may not require the brush at all. At step 1012, a decision may be made as to whether an additional tool is needed. If so, the additional tool may be selected as described beginning at step 1001.

The cleaning of some culverts may require additional, optional steps. For example, a liner may be inserted into the cleaned culvert at step 1014. A liner may help to prevent degradation of the culvert itself, or may helped to slow the subsequent buildup of new debris inside the culvert. In some environments, the debris may have to be removed from the cleaning site at step 1016. This may be due to environmental concerns, or concerns with keeping the area free of loose debris, for example. If the area around the end of the culvert was excavated to allow proper access, it may be necessary to restore the landscape to its original condition at step 1018. Any grills, coverings, or other safety implements may also be replaced at this step.

The foregoing has outlined features of several embodiments according to aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. An apparatus for cleaning a culvert, comprising:

a rod pushing and pulling machine that comprises a motor vehicle;

a rod string comprising a series of extension rods coupled end to end, which rod string is mounted at a proximal end to the rod pushing and pulling machine and extends forwardly from the rod pushing and pulling machine;

wherein the rod pushing and pulling machine is a directional drilling rig capable of rotating the rod string about its lengthwise axis and a debris removal tool mounted on a distal end of the rod string, comprising a rod having a center longitudinal axis, a proximal end, and a distal end, the rod having a coupling at its proximal end configured for connection to a distal end of the rod string, and a bucket at its distal end, which bucket has an end opening positioned so that lengthwise movement of the bucket along the culvert scoops debris into the bucket.

2. The apparatus of claim 1, wherein the bucket has a side opening therein positioned such that, upon removal of the bucket from the culvert using the drilling rig, rotation of the bucket by the drilling rig causes debris in the bucket to fall through the side opening.

3. The apparatus of claim 1, wherein the end opening of the bucket is at a distal end of the bucket, whereby the bucket is operable to push debris out of the culvert.

4. The apparatus of claim 1 , wherein the end opening of the bucket is at a proximal end of the bucket, whereby the bucket is operable to pull debris out of the culvert.

5. The apparatus of claim 1, wherein the bucket has a plurality of teeth operable to loosen debris.

6. The apparatus of claim 1, wherein the extension rods have threaded ends that are coupled end to end.

7. The apparatus of claim 1, further comprising a source of high pressure water connected to the drill string, and a nozzle on the rod of the debris removal tool for injecting high pressure water into the culvert.

8. The apparatus of claim 7, wherein the nozzle is mounted at a distal end of the rod of the debris cleaning tool.

9. An apparatus for cleaning a culvert, comprising:

a directional drilling machine;

a rod string comprising a series of extension rods having male and female threaded ends coupled end to end, which rod string is mounted at a proximal end to the directional drilling machine which can advance or withdraw the drill string from the culvert or rotate the drill string about its lengthwise axis; and a debris removal tool mounted on a distal end of the rod string, comprising a bucket having an end opening positioned so that movement of the bucket along the culvert scoops debris into the bucket.

10. The apparatus of claim 9, wherein the bucket has a side opening therein positioned such that, upon removal of the bucket from the culvert using the drilling machine, rotation of the bucket by the drilling machine causes debris in the bucket to fall through the side opening.

11. An apparatus for cleaning a culvert, comprising:

a rod pushing and pulling machine wherein the rod pushing and pulling machine is a directional drilling rig capable of rotating a rod string about its lengthwise axis;

the rod string comprising a series of extension rods coupled end to end, which rod string is mounted at a proximal end to the rod pushing and pulling machine;

a debris removal tool mounted on a distal end of the rod string, comprising a rod having a center longitudinal axis, a proximal end, and a distal end, the rod having a coupling at its proximal end and a bucket at its distal end, which bucket has an end opening at a proximal end of the bucket facing the rod pushing and pulling machine, so that pulling movement of the bucket along the culvert towards the rod pushing and pulling machine scoops debris into the bucket.

12. The apparatus of claim 11, wherein the bucket has a side opening therein positioned such that, upon removal of the bucket from the culvert using the drilling rig, rotation of the bucket by the drilling rig causes debris in the bucket to fall through the side opening.

13. The apparatus of claim 11, further comprising a source of high pressure water connected to the drill string, and a nozzle on the rod of the debris removal tool for injecting high pressure water into the culvert.

14. The apparatus of claim 13, wherein the nozzle is mounted at a distal end of the rod of the debris cleaning tool, which rod penetrates an end wall of the bucket.

* * * * *